US005152387A

United States Patent [19]

Hammond

[11] Patent Number: 5,152,387

[45] Date of Patent: Oct. 6, 1992

[54] REVERSE VENDING APPARATUS HAVING IMPROVED ARTICLE CRUSHING MECHANISM

[76] Inventor: Nathan J. Hammond, 885 Tanglewood, E. Lansing, Mich. 48823

[21] Appl. No.: 679,565

[22] Filed: Apr. 2, 1991

[51] Int. Cl.[5] ..... G07F 7/06

[52] U.S. Cl. ..... 194/208; 100/176; 100/902

[58] Field of Search ..... 194/208, 209; 100/176, 100/902; 241/230, 234, 235, 236, DIG. 30

[56] References Cited

U.S. PATENT DOCUMENTS

| | | | |
|---|---|---|---|
| 1,314,031 | 8/1919 | Westlake | 241/230 X |
| 3,504,621 | 4/1970 | Qualheim | 100/176 |
| 4,059,050 | 11/1977 | Davis | 100/902 X |
| 4,248,334 | 3/1981 | Hanley et al. | 194/209 |
| 4,248,389 | 2/1981 | Thompson et al. | 241/101.5 |
| 4,480,737 | 11/1984 | Jamgochian et al. | 194/213 |
| 4,919,274 | 4/1990 | Hammond | 209/583 |

*Primary Examiner*—F. J. Bartuska

*Attorney, Agent, or Firm*—Reising, Ethington, Barnard, Perry & Milton

[57] ABSTRACT

A reverse vending apparatus (10) for receiving returnable beverage containers includes a housing (12) having an opening (20) through which an empty beverage container is inserted in exchanger for a redeemable coupon. Inside the housing (12), a V-shaped support trough cradles the container while a conveyor belt (38) rotates the container. An optical scanner (32) inspects the rotating container to identify its origin, and upon recognition that the container is properly returnable electronically signals the apparatus (10) to issue a coupon. The container falls from the support trough and is diverted by a moveable diverter (60) plate to either of two compaction roller sets (56, 58), depending upon the material composition of the container. Wedge-shaped guides (96, 96') funnel the container into the center of the nip between a first (62, 62') and a second, (66, 66') compaction roller to flatten the container. A cleated steel band (82, 82') surrounds the first compaction roller (62, 62'). The second compaction roller (66, 66') is filled with a flexible solid material.

13 Claims, 3 Drawing Sheets

REVERSE VENDING APPARATUS HAVING IMPROVED ARTICLE CRUSHING MECHANISM

TECHNICAL FIELD

The subject invention relates to a reverse vending apparatus wherein a user submits a returnable article and the apparatus issues a value therefor, and more particularly to an improved means for compacting the article.

BACKGROUND ART

Reverse vending apparatus are provided for receiving returnable articles and dispensing a value, i.e., a redeemable coupon or cash, in return. For example, beverage containers frequently carry a deposit price which is refunded upon return of the empty container to a merchant. Apparatus for automatically performing the refund operation are extremely useful to such merchants in that they reduce labor costs, usually automatically account for the articles taken in and the refunds dispensed, and usually crush or shred or otherwise compact the articles received thus diminishing storage space.

One efficient method of compacting the article is to set two oppositely rotating rollers in tangential engagement with each other to form a compacting nip therebetween. The article is then directed into the compacting nip and flattened between the rollers. One example of this prior art method is shown in the U.S. Pat. No. 4,059,050 to Davis, Jr., issued Nov. 22, 1977. Davis discloses an article compacting apparatus including two oppositely rotating rollers, through which articles are directed for crushing. One of the compacting rollers is entirely rigid with cleats extending radially outwardly therefrom. The other roller is resilient. The Davis apparatus is deficient in that as articles pass through the nip, the rigid roller is not permitted to deflect away from the other roller. This increases the chances for damage to the cleats and is expensive to manufacture and maintain.

SUMMARY OF INVENTION AND ADVANTAGES

The subject invention contemplates a reverse vending apparatus for receiving returnable articles and dispensing a value therefor. The subject apparatus comprises a housing and an identifier means for identifying the origin of the article supported in the support means and issuing a value in response to recognition of a properly acceptable article. A first compaction roller has a generally circular rigid periphery and is supported for rotation in the housing about a first axis. A second compaction roller also has a generally circular periphery and is supported for rotation in the housing about a second axis which is spaced parallel from the first axis such that the rigid periphery of the first compaction roller tangentially contacts the periphery of the second compaction roller. A motor means is provided for rotating the first compaction roller and the second compaction roller in opposite directions to form a downwardly thrusting compacting nip therebetween. The invention is characterized by the first compaction roller including a flexible hub means interconnecting the rigid periphery and the first axis for permitting unitary deflection of the rigid periphery away from the second roller when an obstruction enters the compacting nip while the first axis remains fixedly spaced relative to the second axis to improve the crushing of articles between the first and second compaction rollers.

The flexible hub means is significantly more efficient at compacting articles than the prior art rigid rollers. The flexible hub means permits the rigid exterior periphery of the first compaction roller to deflect away from the second compaction roller when a partially incompressible article is passed through the compacting nip. The flexible hub means, therefore, significantly extends the life of the subject apparatus, and can even be used to vary the amount of crushing pressure applied to articles by the compacting nip. Also, the flexible hub means is inexpensive to manufacture and to maintain.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 2:
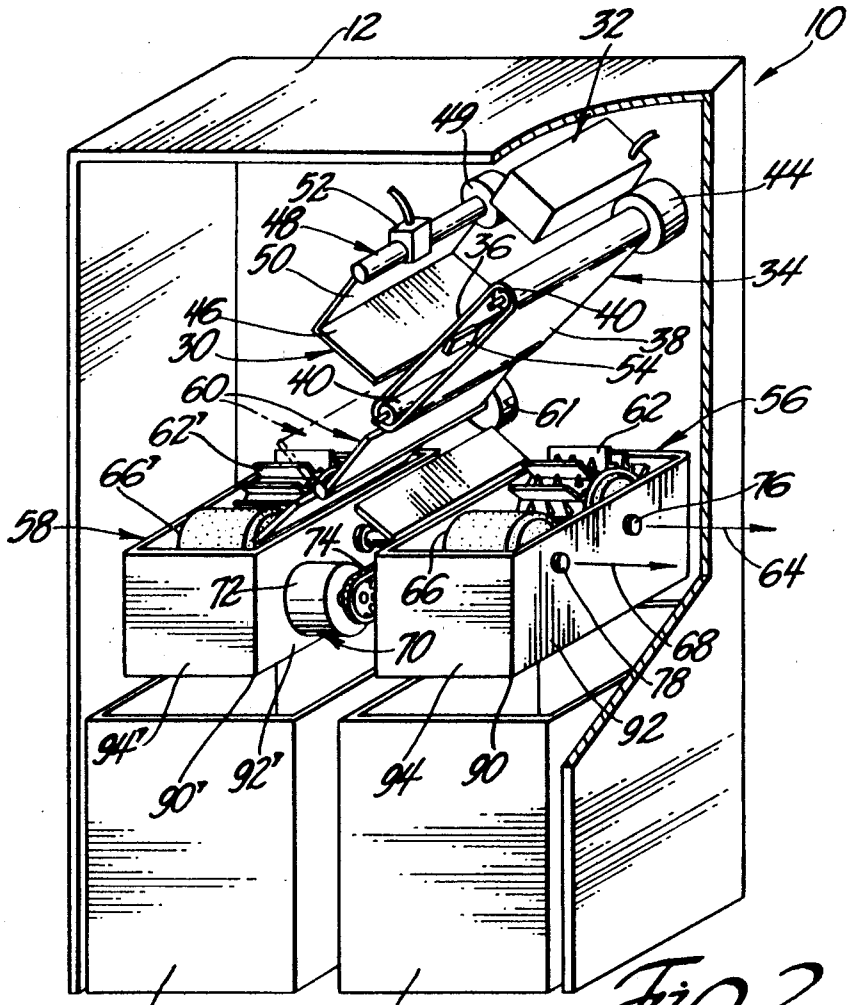
FIG. 2 is a simplified perspective view of the subject invention as in FIG. 1 showing the top and bottom access doors removed and having a portion of the housing broken away.
Figure 1:
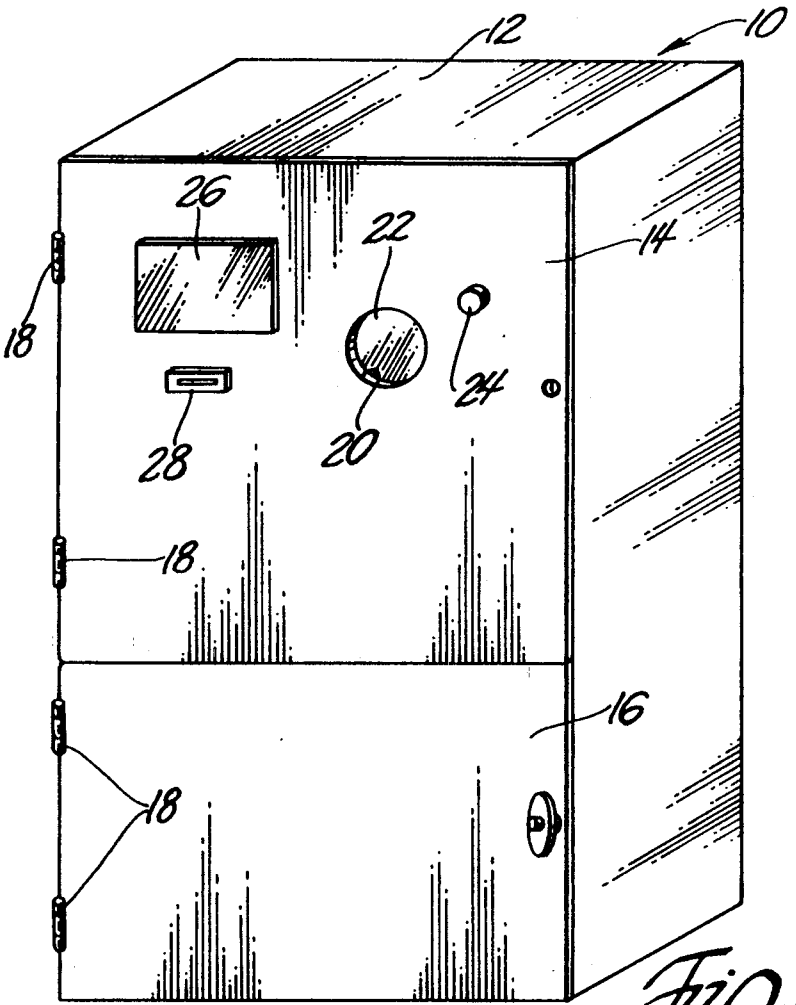
FIG. 1 is a simplified perspective view of the subject invention.

Referring now to the Figures, wherein like numerals indicate like or corresponding parts throughout the several views, a reverse vending apparatus according to the subject invention is generally shown at 10 in FIGS. 1 and 2. The reverse vending apparatus 10 receives returnable, generally cylindrical articles A and dispenses a value therefor. For example, beverage containers frequently carry a deposit price which is refunded to the consumer upon return of the empty container. The apparatus 10 administers such refunds by way of cash or, more preferably, by dispensing a paper coupon for the full redemption price. Besides the typical beverage container, the subject apparatus 10 can also accept environmentally hazardous products such as old dry cell batteries, empty bleach or chlorine bottles, and the like. However, it is important that any returnable article A have at least some degree of cylindricity, as to enable the article A to be rotated in view of an electronic optical scanning device.

In FIG. 1, the subject apparatus 10 is shown including a housing 12 of generally box-like construction and preferably fabricated from a metallic sheet stock. A top access door 14 and a bottom access door 16 are both supported on the front side of the housing 10 by respective pairs of hinges 18. The top access door 14 permits installation and service access to the various mechanisms disposed within the housing 12. The bottom access door 16 allows the collected returned articles A to be periodically emptied from the apparatus 10.

As shown in FIG. 1, the apparatus 10 includes an article insertion opening 20, through which a user inserts the article A submitted for refund. In FIG. 1, the insertion opening 20 is shown covered by a solid door 22. The door 22 is a protective covering for preventing fingers, clothing, etc. from entering the apparatus 10 during its active operation. The apparatus 10 also includes a start button 24 which is actuated after a user inserts an article A into the opening 20. Upon actuation of the start button 24, the door 22 closes thereby preventing access to the opening 20 until the apparatus 10 has determined whether to accept or reject the article A. A video display screen 26 provides written instructions to the user. A dispenser 28 dispenses the value, either cash or coupon, in exchange for a properly returnable article A.

The subject apparatus 10 includes a support means, generally indicated at 30 in FIG. 2, disposed in the housing for supporting a generally cylindrical article A within the housing. That is, the support means 30 is located directly behind the opening 20 and receives and supports an article A once inserted through the opening 20.

An identifier means is generally indicated at 32 in FIG. 2. The identifier means 32 is provided for identifying the origin of an article A supported in the support means 30 and issuing a valve in response to recognition of a properly acceptable article A. The identifier means 32 is located close to the support means 30 so that an article A supported in the support means 30 is in full view of the identifier means 32. The identifier means 32 scans any article A submitted for return to identify its source and the value of any refund. This is accomplished by matching the identifying characteristics on the article A with a stored reference library in a computer. Preferably, the identifier means 32 comprises an optical scanner which accounts for the size, shape, color, UPC bar code, and label indicia while making the determination whether the article A is properly returnable. If the article A is identified as being properly returnable, the identifier means 32 issues the user a commensurate refund from the dispenser 28. If the article A is not recognized by the identifier means 32, then the door 22 reopens to allow the user to remove the article A from the apparatus 10.

Figure 3:
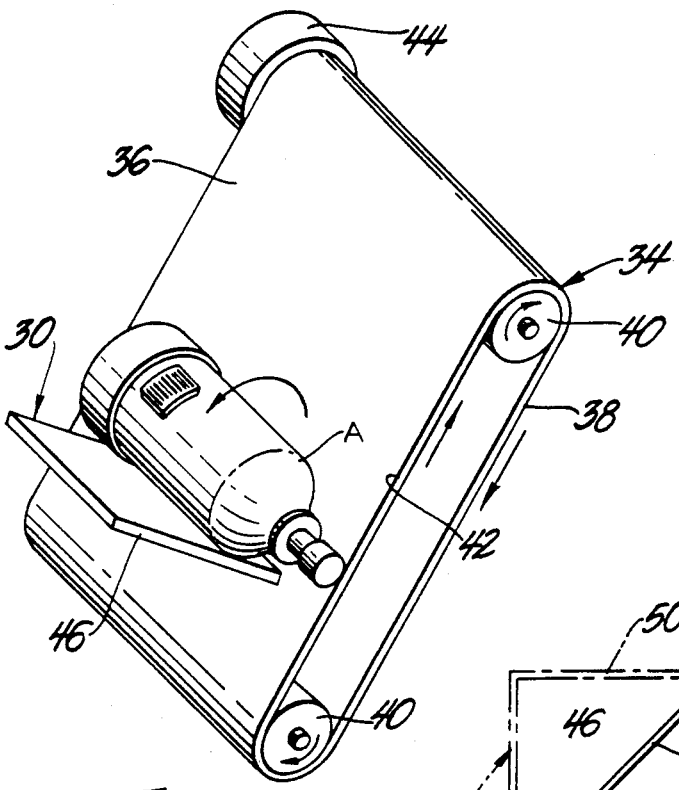
FIG. 3 is a perspective view of the translation means and showing an article being rotated thereby.
Figure 4:
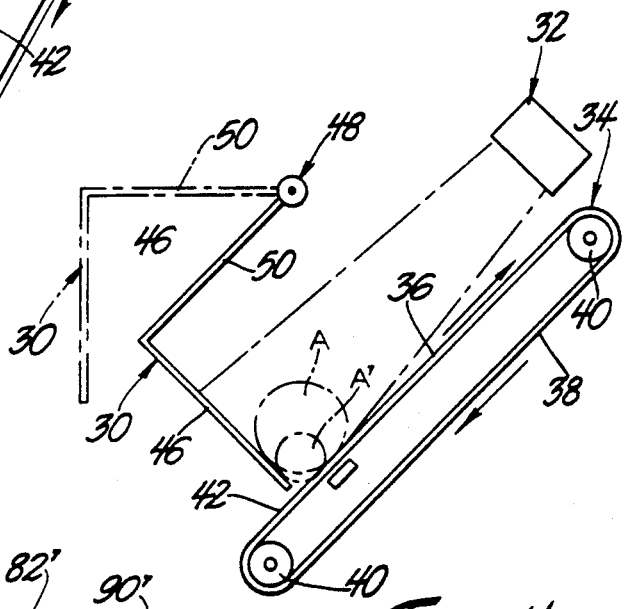
FIG. 4 is a front view of the translation means and the support means and showing in phantom various sized articles supported in the V-shaped support trough.
Figure 7:
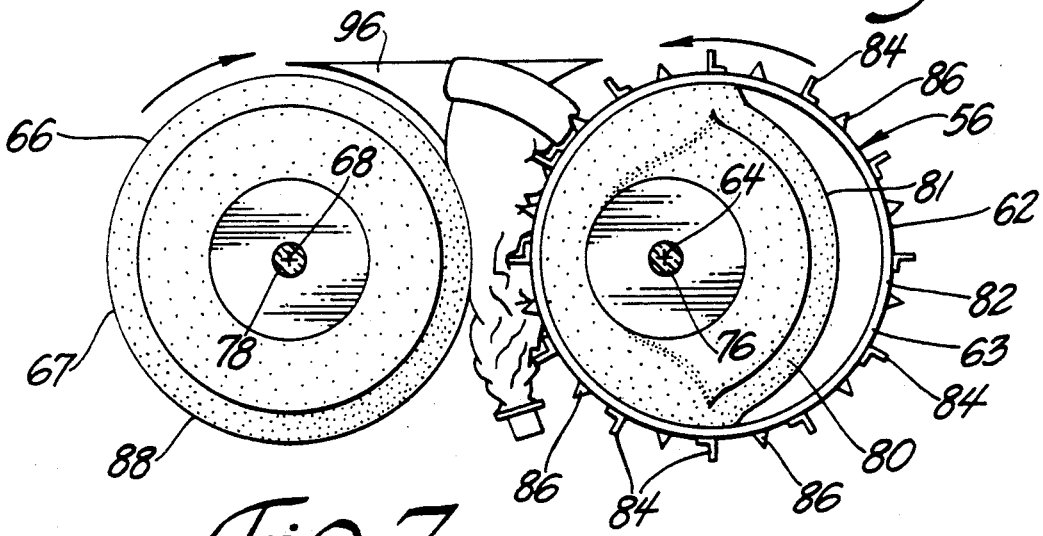
FIG. 7 is a side view as in FIG. 6 showing an article passing between the first and second compaction rollers.

A translation means is generally indicated at 34 in FIGS. 2–4. The translation means 34 is provided for translating a substantially planar surface 36 in frictional and tangential engagement with an article A supported by the support means 30 to induce rotation of the article A and thereby assist the identifier means 32 to rapidly identify the origin of the rotating article A. In FIGS. 3, 4, and 7 an article A is represented by an empty plastic beverage container. The generally cylindrical shape of the article A permits the translation means 34 to rotate the article A while it is supported in the support means 30. Small dents or flat spots which do not substantially interfere with the rotation of the article A will not prevent the article A from being considered at least generally cylindrical.

As best shown in FIG. 2, the planar surface 36 is supported in the housing 12 on an incline with respect to the horizontal. This inclined planar surface 36 is actually formed by an endless conveyor belt 38 supported on a pair of spaced wheels 40, vertically and horizontally offset within the housing 12, as shown in FIG. 2. The planar surface 36 is created between the two wheels 40 on an upper inclined surface 42 of the conveyor belt 38 so that the planar surface 36 can continuously translate while remaining stationary, as a unit, within the housing 12. The conveyor belt 38 is formed of a flexible material and is relatively wide to accommodate articles A of varying lengths. A conveyor motor 44 is operatively engaged with one of the wheels 40 in order to power the conveyor belt 38, as shown in FIGS. 2 and 3. The conveyor motor 44 rotates the one wheel 40 in a direction to cause the planar surface 36 to move away from the support means 30. Therefore, the directional movement of the planar surface 36 operates to decrease the force applied to the support means 30 by the article A, thus enabling deformed articles A to be rotated all the more easily.

Referring to FIGS. 2, 3, and 4, the support means 30 is shown including a shelf 46 inclined relative to the horizontal and disposed adjacent the planar surface 36 to form a generally V-shaped article support trough. An article A, therefore, is supported on one side by the shelf 46 of the support means 30 and on the other side by the inclined planar surface 36 of the translation means 34. Gravity acting on the article A urges the article A toward the bottom of the V-shaped tough formed between the planar surface 36 and the shelf 46. FIG. 4 illustrates the adaptability of the V-shaped trough to supporting articles A, A' of different sizes, shown in phantom.

Because of the orientation of the conveyor belt 38 on the left and the shelf 46 on the right in the preferred embodiment shown in FIG. 2, the directional movement of the planar surface 36 will cause a counterclockwise rotation of the article A, as shown in FIGS. 3 and 4. This has the desirable effect of decreasing the force applied to the shelf 46 by the rotating article A, and consequently permits the translation means 34 to more easily rotate dented or partially crushed articles A. Conversely, if the planar surface 36 were to move toward the support means 30, then a deformed article A would be forced into the converging bottom of the V-shaped trough which would make it more difficult to rotate the article A. However, the subject invention moves the planar surface 36 away from the shelf 46 thereby tending to pull, or lift, the article A out of the bottom of the V-shaped trough.

The support means 30 further includes a discharge means, generally indicated at 48 in FIG. 2, for moving the shelf 46 away from the planar surface 36 to allow the article A to fall from planar surface 36 under the influence of gravity. Thus, the discharge means 48 opens the V-shaped trough upon moving the shelf 46 away from the planar surface 36. The discharge means 48, more particularly, includes a discharge motor 49 for pivoting the shelf 46 away from the planar surface 36 in response to recognition of an acceptable article A. The discharge motor 49 rotates the shelf 46 away from the conveyor belt 38 about an axis that is generally parallel to the planar surface 36.

The support means 30 also includes a rigid plate 50 extending perpendicularly upwardly from the shelf 46 and interconnecting the discharge motor 49 and the shelf 46. The rigid plate 50 and the shelf 46 are integral and form a unitary L-shaped member, as shown in FIGS. 2 and 4. Therefore, the discharge motor 49 rotates the rigid plate 50 and the shelf 46 together, away from the planar surface 36, to allow the article A to fall downwardly from the conveyor belt 38.

The support means 30 includes a weight sensor 52, shown in FIG. 2. The weight sensor 52 is provided for determining whether an article A supported by the support means 30 exceeds a predetermined maximum allowable weight. Because vandals may attempt to insert a container filled with a harmful substance in the apparatus 10, the weight sensor 52 first ensures that the article A is within the proper weight range for an article A of its character. Also, a detection means 54 is disposed adjacent the support means 30 for detecting the presence of magnetically attractive substances in the V-shaped support trough. More specifically, the detection means 54 is disposed behind the planar surface 36 as shown in FIGS. 2 and 4. Because vandals or ignorant users may insert a steel article into the apparatus, which steel article would damage the compaction mechanisms inside the apparatus 10, the detection means 54 alerts the identifier means 32 whenever an article A submitted for refund is of a steel composition.

Figure 5:
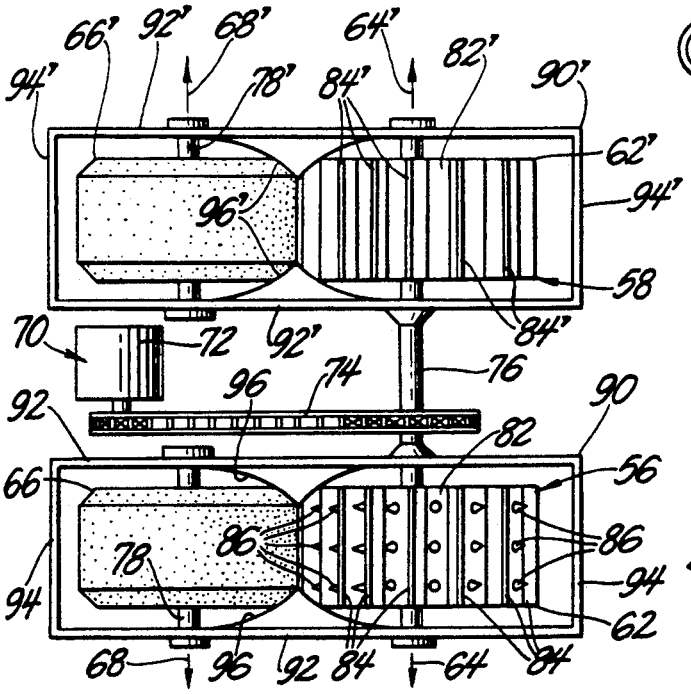
FIG. 5 is a top view of the right and left compaction means.

In FIGS. 2 and 5, the subject apparatus 10 is shown including a right compaction means, generally indicated at 56, disposed below the V-shaped support trough for compacting an article A after it has fallen from the planar surface 36. Likewise, the apparatus 10 includes a left compaction means, generally indicated at 58, disposed below the support trough and adjacent the right compaction means 56 also for compacting an article A that has fallen from the planar surface 36. However, the right compaction means 56 is dedicated to compacting only nonmetallic articles A, whereas the left compaction means 58 is dedicated to compacting only metallic, e.g., aluminum, articles A. As will be described in greater detail subsequently, the left 58 and right 56 compaction means are generally identical.

To ensure that only nonmetallic articles A are directed to the right compaction means 56 and only metallic articles to the left compaction means 58, the subject apparatus 10 includes a diverter means, generally indicated at 60 in FIG. 2, disposed between the support trough and the right and left compaction means 56, 58 for diverting falling articles A to one to the right 56 and left 58 compaction means depending upon the compositional, i.e., metallic or nonmetallic, nature of the falling article A. The diverter means 60 comprises a rigid sheet-like member which can be rotated approximately 90° to the position shown in phantom in FIG. 2. A diverter motor 61 rotates the diverter means 60 about an axis generally parallel to the planar surface 36. When the diverter means 60 is in position to direct a falling article A to the left compaction means 58, as shown in FIG. 2, the sheet-like member extends from the bottom of the conveyor belt 38 along the same plane to form a continuous rolling surface over which the article A traverses. However, when the diverter means 60 is in position to direct the falling article A to the right compaction means, as shown in phantom in FIG. 2, the sheet-like member is generally perpendicular to the planar surface 36 and diverts the downwardly falling article A to the right compaction means 56.

Figure 6:
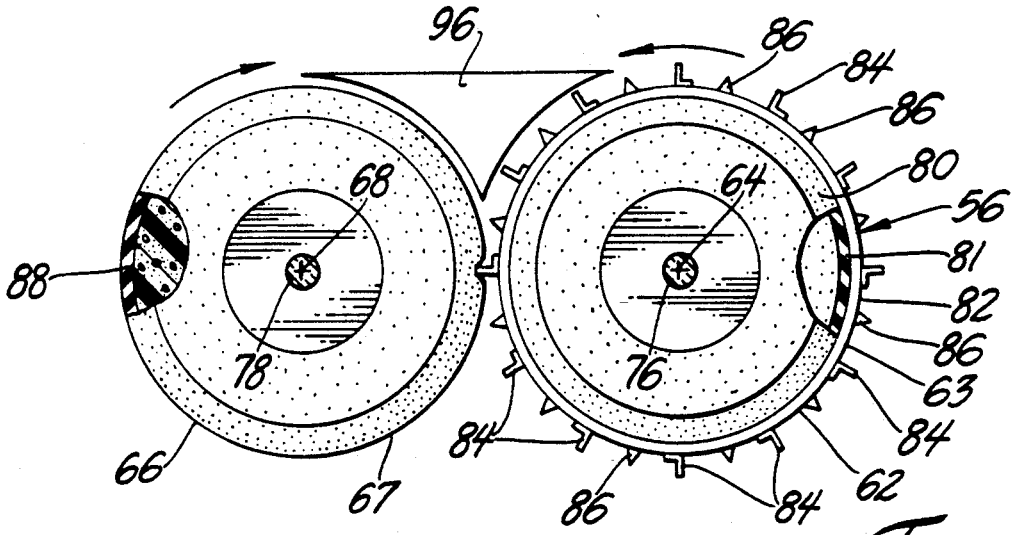
FIG. 6 is a side view of the first compaction roller and the second compaction roller of the right compaction means.

Because the left 58 and right 56 compaction means are generally identical, the following detailed description will entail only the right compaction means 46. Corresponding parts on the left compaction means 58 are referenced by a prime designation in the Figures and, where necessary, given specific description in the ensuing text. The right compaction means 56 includes a first compaction roller 62 having a generally circular rigid exterior periphery 63 and supported for rotation in the housing 12 about a first axis 64. The right compaction means 56 also includes a second compaction roller 66 having a generally circular periphery 67 and supported for rotation in the housing 12 about a second axis 68 spaced parallel from the first axis 64 such that the rigid periphery 63 of the first compaction roller 62 tangentially contacts the periphery 67 of the second compaction roller 66, as best illustrated in FIGS. 5, 6, and 7.

A motor means, generally indicated at 70, is provided for rotating the first compaction roller 62 and the second compaction roller 66 in opposite directions to form a downwardly thrusting compacting nip therebetween. Therefore, as an article A falls from the V-shaped support trough and is directed to the right compaction means 56, the article A is caught between the exterior peripheries 63, 67 of the first 62 and second 66 compaction rollers, and pinched or squeezed to flatted the article A. More specifically, the motor means 70 is operatively connected to the first compaction roller 62 with the second compaction roller 66 being rotated by way of its frictional engagement with the first compaction roller 62. The motor means 70 is best shown in FIG. 5 including an electric motor 72 connected by a roller chain 74 to a live axle 76. The first compaction rollers 62, 62' of both the right 56 and left 58 compaction means are fixedly attached to the live axle 76 so that the electric motor 72 simultaneously powers both. The second compaction roller 66, on the other hand, is independently driven only by way of its engagement with the first compaction roller 62. Accordingly, the second compaction roller 66 is supported on a free axle 78.

The first compaction roller 62 includes a flexible hub means 80 interconnecting its rigid periphery 63 and the first axis 64, i.e., the live axle 76, for permitting unitary deflection of its rigid periphery 63 away from the second compaction roller 66 when an incompressible obstruction enters the compacting nip while the first axis 64 remains fixedly spaced relative to the second axis 68 to improve the crushing of articles A between the first 62 and second 66 compaction rollers. More specifically, the flexible hub means 80 substantially reduces the shock on the right 56 and left 58 compaction means by permitting the exterior rigid periphery 63, 63' of the respective first compaction rollers 62, 62' to deflect when an article A passes through the compacting nip. As illustrated in an exaggerated manner in FIG. 7, an article A passing through the nip will force the rigid exterior periphery 63 of the first compaction roller 62 to compress along the side adjacent the nip while the live axle 76 remains rotating in its fixed support.

The flexible hub means 80 includes a hollow elastomeric shell 81 filled with a pressurized gas, such as air. The elastomeric shell 81 preferably comprises a rubber material as typically found on small pneumatic tires. The rigid periphery 63 of the first compaction roller 62 comprises an annular metallic band 82. The band 82 is fabricated from a steel material so as to be durable and hard. A plurality of cleats 84 extend radially outwardly from the rigid periphery 63. The cleats 84 are disposed parallel to the first axis 64 of the live axle 76 so that while compressing an article A passing through the nip, the cleats 84 will form creases in the article A and cause the article A to remain locked in its compressed condition after passing completely through the nip.

Referring to the right compaction means 56 only, a plurality of spikes 86 extend radially outwardly from the rigid periphery 63 of the steel band 82. The function of the spikes 86 is to puncture air holes in the plastic articles A directed into the right compaction means 56. The spikes 86 create ventilation holes in plastic containers to ensure that they can be properly compacted. Because metallic articles A will already include ventilation holes, the left compaction means 58 does not include spikes 86.

The flexible hub means 80 is particularly advantageous in that the degree of crush, or amount of pressure, exerted on an article A passing through the nip can be controlled by varying the amount of air pressure inflated into the elastomeric shell 81. The more solidly it is desired to crush an article A, the more air pressure is inflated into the shell 81. Also, the first compaction roller 62 is easily assembled to the steel band 82 in that the shell 81 of the flexible hub means 80 need only be deflated in order to remove or install the steel band 82. Therefore, servicing of the subject apparatus is made simple and quick.

The second compaction roller 66 also includes a hollow elastomeric shell 88 having an exterior surface defining its circular exterior periphery 67. The elastomeric shell 88 preferably comprises a rubber material similar to the first compaction roller 62. However, as distinguished from the first compaction roller 62, the elastomeric shell 88 of the second compaction roller 66 is filled with a solid elastomeric material, e.g., urethane. This makes the second compaction roller 66 deflation proof and provides firm support against which the first compaction roller 62 compresses articles A.

Figure 8:
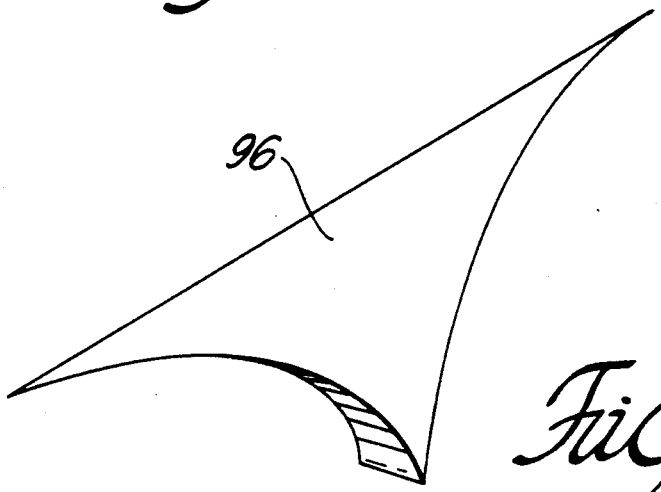
FIG. 8 is a perspective view of the funnel means.

A box-shaped shroud 90, 90' having two parallel sides 92, 92' and two parallel ends 94, 94' surrounds each of the first 62, 62' and second 66, 66' compaction rollers, respectively, as shown in FIGS. 2 and 5. The live axle 76 and the two free axles 78, 78' of the right 56 and left 58 compaction means are supported through the respective shrouds 90, 90'. A funnel means 96 is disposed vertically above the compacting nip of each of the right 56 and left 58 compaction means for guiding articles A into the respective compacting nips. More particularly, the funnel means 96 comprises a pair of wedge-shaped guides extending inwardly from the two sides of the shroud 90, 90', as shown in FIGS. 5 and 8. Therefore, when an article A is diverted to either of the left 58 or right 56 compaction means, the funnel means 96 ensures that the article A moves into the middle of the nip, otherwise the article A might become wedged between the shroud 90, 90' and the side of one of the compaction rollers 62, 62', 66, 66'.

A receptacle means 98, 98' is disposed vertically below the compacting nip of the right 56 and left 58 compaction rollers, respectively, for collecting crushed articles A exiting the compacting nips, as shown in FIG. 2. The bottom access door 16 is provided for the convenient periodic emptying of compacted articles A from the receptacle means 98, 98'.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A reverse vending apparatus (10) for receiving returnable articles (A) and dispensing a value therefor, said apparatus (10) comprising;

a housing (12);

identifier means (32) disposed in said housing (12) for identifying the origin of the article (A) submitted for return and issuing a value in response to recognition of a properly acceptable article (A);

a first compaction roller (62) having a generally circular rigid periphery (63) and supported for rotation in said housing (12) about a first axis (64);

a second compaction roller (66) having a generally circular periphery (67) and supported for rotation in said housing (12) about a second axis (68) spaced parallel from said first axis (64) such that said rigid periphery (63) of said first compaction roller (62) tangentially contacts said periphery (67) of said second compaction roller (66);

motor means (70) for rotating said first compaction roller (62) and said second compaction roller (66) in opposite directions to form a downwardly thrusting compacting nip therebetween;

and characterized by said first compaction roller (62) including flexible hub means (80) interconnecting said rigid periphery (63) and said first axis (64) for permitting unitary deflection of said rigid periphery (63) away from said second compaction roller (66) when an obstruction enters said compacting nip while said first axis (64) remains fixedly spaced relative to said second axis (68) to improve the crushing of articles (A) between said first (62) and second (66) compaction rollers, said flexible hub means (80) including a hollow elastomeric shell (81) and a pressurized gas contained within said elastomeric shell (81).

2. An apparatus (10) as set forth in claim 1 further characterized by said elastomeric shell (81) comprising a rubber material.

3. An apparatus (10) as set forth in claim 1 further characterized by said rigid periphery (63) of said first compaction roller (62) comprising an annular metallic band (82).

4. An apparatus (10) as set forth in claim 3 further characterized by said annular metallic band (82) including a plurality of cleats (84) extending radially outwardly from said rigid periphery (63).

5. An apparatus (10) as set forth in claim 4 further characterized by said cleats (84) disposed parallel to said first axis (64).

6. An apparatus (10) as set forth in claim 4 further characterized by said metallic band (82) including a plurality of spikes (86) extending radially outwardly from said rigid periphery (63).

7. An apparatus (10) as set forth in claim 4 further characterized by said second compaction roller (66), including a hollow elastomeric shell (88) having an exterior surface defining said periphery (67).

8. An apparatus (10) as set forth in claim 7 further characterized by said elastomeric shell (88) of said second compaction roller (66) comprising a rubber material.

9. An apparatus (10) as set forth in claim 7 further characterized by said elastomeric shell (88) of said second compaction roller (66) being filled with a solid elastomeric material.

10. An apparatus (10) as set forth in claim 9 further characterized by said motor means (70) being operatively connected to said first compaction roller (62) with said second compaction roller (66) being rotated by way of frictional engagement with said first compaction roller (62).

11. An apparatus (10) as set forth in claim 10 further characterized by including funnel means (96) disposed vertically above said compacting nip for guiding articles (A) into said compacting nip.

12. An apparatus (10) as set forth in claim 11 further characterized by a box-shaped shroud (90) having two parallel sides (92) and two parallel ends (94) surrounding said first (62) and second (66) compaction rollers, and said funnel means (96) comprising a pair of wedge-shaped guides extending inwardly from said two sides (92).

13. An apparatus (10) as set forth in claim 12 further characterized by receptacle means (98) disposed vertically below said compacting nip for collecting crushed articles (A) exiting said compacting nip.

* * * * *